US006651635B2

(12) United States Patent
Kunimitsu et al.

(10) Patent No.: US 6,651,635 B2
(45) Date of Patent: Nov. 25, 2003

(54) BREATHER APPARATUS FOR FOUR-CYCLE ENGINE

(75) Inventors: Motohide Kunimitsu, Hamakita (JP); Kazuhito Nakamura, Shizuoka-ken (JP)

(73) Assignee: Suzuki Motor Corporation, Hamamatsu (JP)

( * ) Notice: Subject to any disclaimer, the term of this patent is extended or adjusted under 35 U.S.C. 154(b) by 0 days.

(21) Appl. No.: 10/267,163

(22) Filed: Oct. 9, 2002

(65) Prior Publication Data

US 2003/0079729 A1 May 1, 2003

(30) Foreign Application Priority Data

Oct. 25, 2001 (JP) ..... 2001-328240

(51) Int. Cl.[7] ..... F01M 13/00
(52) U.S. Cl. ..... 123/572
(58) Field of Search ..... 123/572, 573, 123/574, 41.86

(56) References Cited

U.S. PATENT DOCUMENTS 5,690,084 A * 11/1997 Gunji et al. ..... 123/572
6,142,129 A * 11/2000 Hori et al. ..... 123/572
6,425,451 B2 * 7/2002 Yoshida et al. ..... 123/572

FOREIGN PATENT DOCUMENTS

JP 5-179925 7/1993
JP 07-324614 12/1995 ..... F01M/13/00
JP 07-324614 A1 12/1995
JP 8-193508 7/1996
JP 11-022443 A1 1/1999
JP 11-022443 1/1999 ..... F01M/13/04

OTHER PUBLICATIONS

Patent Abstracts of Japan; Publication No. 05–179925, Jul. 20, 1993; (English Translation).
Patent Abstracts of Japan; Publication No. 08–193508, Jul. 30, 1996; (English Translation).

* cited by examiner

*Primary Examiner*—Marguerite McMahon
(74) *Attorney, Agent, or Firm*—Darby & Darby

(57) ABSTRACT

The present invention provides a breather apparatus for a 4-cycle engine in which oil in a blow-by gas can be separated. The engine's starter includes a kick idle gear that transmits a rider's pedal force to the crankshaft. A hollow kick idle shaft rotates together with the kick idle gear and a clutch body whereby sprayed oil mist mixed in blow-by gas is separated by centrifugal force. The hollow kick idle shaft opens up into a breather passage, with a blow-by gas intake port on one end and a blow-by gas exhaust port on the other, through which the blow-by gas flows. Only blow-by gas without oil mist is re-circulated to an air cleaner and then to the combustion chamber to be burned again with new air. The oil mist returns to the oil pan in a transmission chamber.

12 Claims, 8 Drawing Sheets

BREATHER APPARATUS FOR FOUR-CYCLE ENGINE

FIELD OF THE INVENTION

This invention relates to a breather apparatus for a 4-cycle engine.

BACKGROUND OF THE INVENTION

In an engine, gas pressurized in the cylinder gradually leaks or blows-by into the crankcase through a separation between the piston and the cylinder bore. The pressure of the gas in the crankcase fluctuates as the piston slides, and if the crankcase is tightly sealed, piston movement is inhibited. Therefore, it is necessary to release the blow-by gas and to separate the sprayed oil mixed in the blow-by gas with a breather apparatus.

Japanese Unexamined Patent No. Hei-7-324614 is a typical breather apparatus in which one end of a breather passage connects to a breather chamber, thereby reducing the pressure of the blow-by gas and separating the oil in the blow-by gas. This apparatus' efficiency depends on the size of the breather chamber, but as the size of the breather chamber is increased, so is the weight of the engine. Furthermore, the apparatus requires a maze structure and an orifice in the breather chamber in order to separate oil. This is a complicated structure. Finally, since the pressure where the separated lubrication oil is returned is greater than the atmospheric pressure, lubrication oil collection is difficult.

Japanese Unexamined Patent No. Hei-11-22443 discloses an apparatus in which blow-by gas is guided into a hollow balancer shaft where a disk-shaped member such as a balancer weight is located. This disk-shaped member includes an oil separating passage where the oil in the blow-by gas is separated. Although the breather chamber is eliminated, the balancer shaft diameter and layout must be exact, making the structure of the balancer shaft complicated.

The present invention addresses these problems and provides a simple breather apparatus for a 4-cycle engine which allows separation of oil in blow-by gas.

SUMMARY OF THE INVENTION

According to the present invention, in a 4-cycle engine, the inside of the crankcase is divided by a bulk head into two chambers: (1) the crank chamber that houses a crankshaft and (2) the transmission chamber in which a clutch body is supported by a counter shaft. An oil pan stores lubrication oil in each chamber. A pair of oil pumps are provided in the crank chamber, one of which takes in lubrication oil from the oil pan in the crank chamber and the other of which takes in lubrication oil from the oil pan in the transmission chamber. A kick engine starter is provided which transmits a rider's pedal force to the crankshaft via a plurality of gears and includes a kick idle gear that transmits a rider's pedal force to the crankshaft via a clutch body. A hollow kick idle shaft rotates with and supports one end of this kick idle gear and is located on the upper rear of the counter shaft in the transmission chamber so that at least a part of it overlays the clutch body when viewed from the side. A breather passage is provided in the kick idle shaft. A blow-by gas intake port is provided on the side end of the kick idle gear of the breather passage, and a blow-by gas exhaust port is provided on the end of its opposite side.

The kick idle gear may be arranged opposite to and facing the clutch body with the blow-by gas intake port, which communicates with the breather passage, in the kick idle shaft located on this kick idle gear.

A generator chamber, separate from the crankcase, may be located on the left side of the crankcase and lies on the crank and transmission chambers. A covered generator is housed in the generator chamber. Two holes connect the crank and transmission chambers to the lower and upper sides of the generator, respectively. A check valve in the upper hole restricts backflow from the transmission chamber to the generator chamber. The lower hole is placed above the lubrication oil level in the crank chamber's oil pan.

In the breather apparatus for a 4-cycle engine of this present invention, oil in blow-by gas can be separated by a simple structure as described above, thus making a breather chamber unnecessary, and thereby allowing the engine structure to be more compact, lightweight and simple. Furthermore, when guiding blow-by gas from the crank chamber to the transmission chamber, the lubrication oil does not flow into the transmission chamber, and the blow-by gas does not back-flow into the crank chamber. In addition, the lubrication oil in the crank chamber's oil pan does not flow into the generator chamber.

DESCRIPTION OF THE PREFERRED EMBODIMENTS

Figure 1:
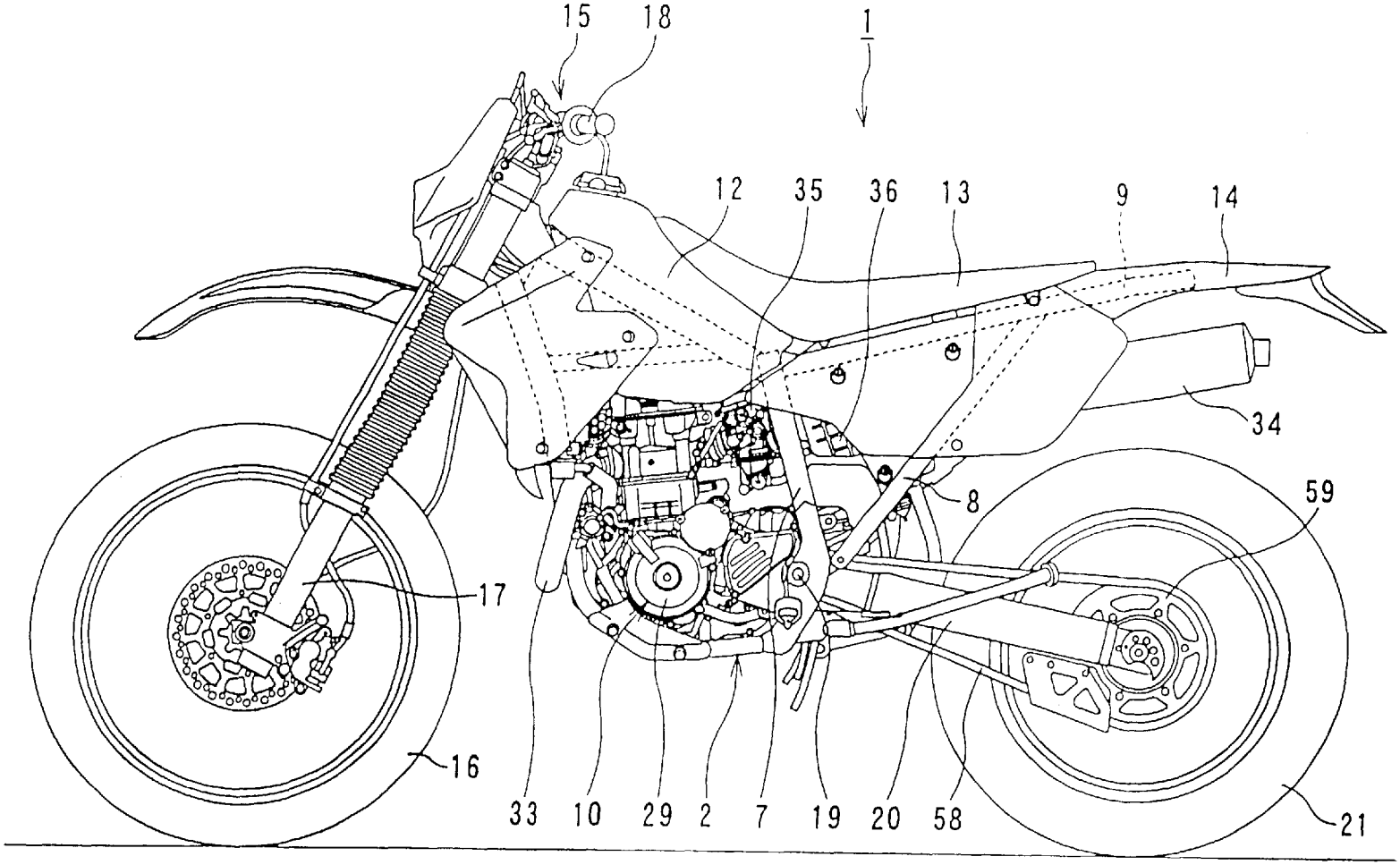
FIG. 1 is a left side view of the motorcycle with a breather apparatus for a 4-cycle engine, according to the invention.
Figure 2:
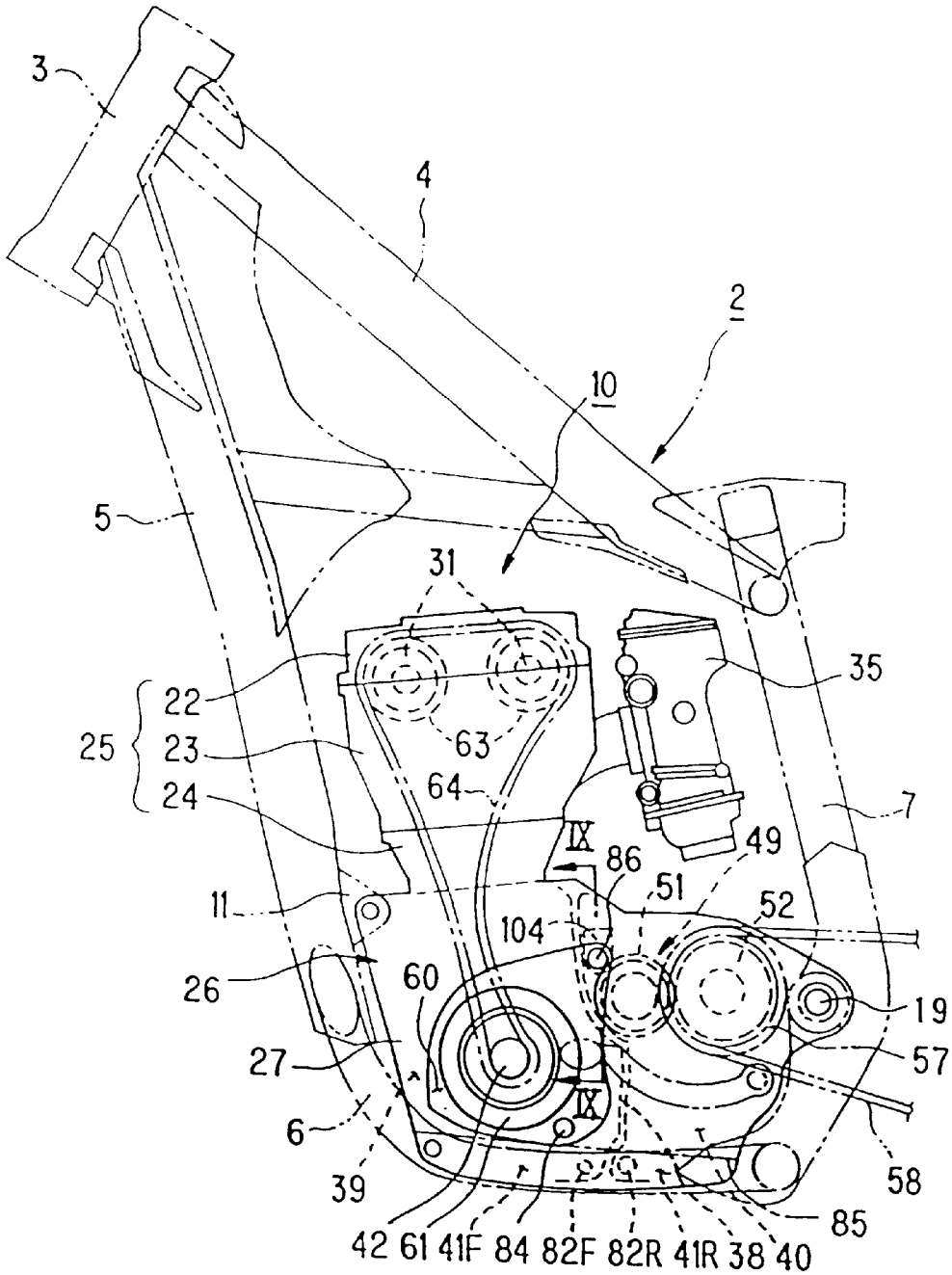
FIG. 2 is an enlarged left side view of a middle portion of a body.
Figure 3:
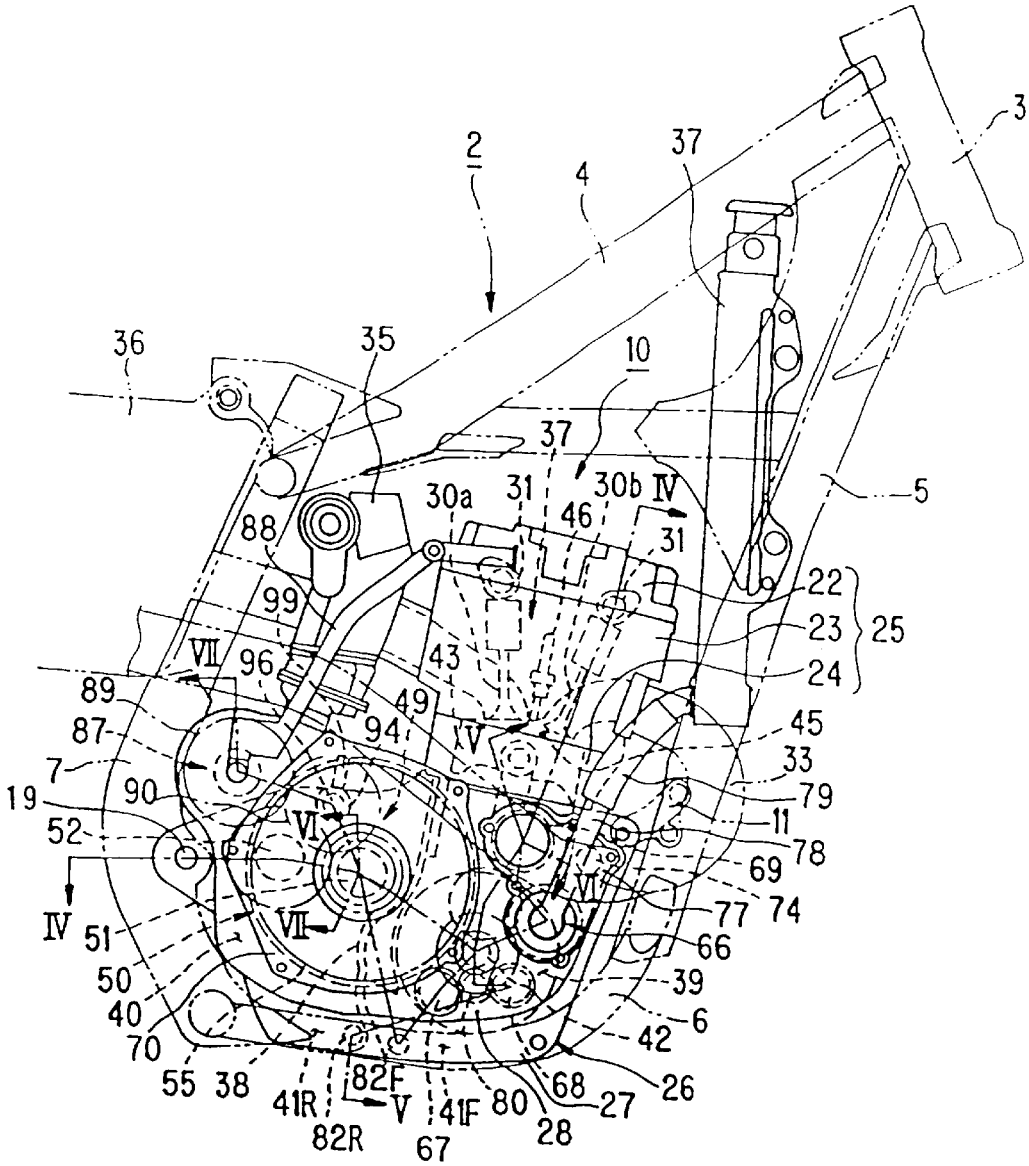
FIG. 3 is an enlarged right side view of a middle portion of a body.

As shown in FIGS. 1–3, a motorcycle 1 may have a vehicle frame 2 of a semi-double cradle frame type that commonly includes head pipe 3, tank rail 4, down tube 5, under tube 6, main tube 7, rear pipe 8 and seat rail 9.

In the front portion of the motorcycle vehicle frame 2, the tank rail 4 extends diagonally downward from the upper rear of the head pipe 3 which is attached to the front head of the vehicle frame 2. The down tube 5 extends generally downward from the lower rear of the head pipe 3 and connects with the left and right under tubes 6. This pair of under tubes 6 extends downward, bends rearward halfway and then extends generally horizontally. The rear end of the under tubes 6 connect to the pair of right and left main tubes 7 which extend generally downward. The upper ends of the main tubes 7 connect to the rear end of the tank rail 4 from both sides.

In the back half of the motorcycle, the front ends of the pair of right and left seat rails 9 connect to the rear end of the tank rail 4. A pair of right and left rear pipes 8 extends forward and downward from the vicinity of the middle of the seat rail 9 to the main tube 7.

As shown in FIGS. 2 and 3, the lower front, upper front and rear engine 10 is secured to the vehicle frame 2. Specifically, the upper front of the engine 10 is secured to the down tube 5 via stay 11, and the lower front of the engine 10 is sandwiched between the bent portions of the right and left under tubes 6.

The rear of the engine 10 is secured between the right and left main tubes 7, whose respective mounting portions form an approximate isosceles triangle when viewed from the side. The bottom face of engine 10 lies above the bottom of the under tube 6 so that part of engine 10 overlaps the horizontal portion of the under tube 6 when viewed from the side, as shown in FIGS. 2 and 3. A fuel tank 12 is placed above the tank rail 4, and a driving seat 13 and a rear fender 14 are secured to the seat rail 9.

A steering mechanism 15 in head pipe 3 includes front forks 17 and handle bar 18 and allows front wheel 16 to pivot to either side. A swing arm 20 is mounted to allow pivoting on the pivot shaft 19 which is placed on the lower part of the main tube 7. A rear drive wheel 21 can pivot on the rear part of the swing arm 20.

As shown in FIGS. 1–7, for example, the engine 10 is a 4-cycle single cylinder engine. A cylinder assembly 25 tilts forward slightly on a cylinder case 26 and comprises, from top to bottom: a head cover 22, a cylinder head 23, and a cylinder block 24.

The engine case 26 comprise right and left crankcases 27 which are divided into two along the width of the vehicle, i.e., perpendicular to the vehicle's moving direction, into a clutch housing 28 on the right side and a generator cover 29 on the left side. The clutch housing 28 and generator cover 29 lie above the horizontal portion of the under tube 6 and protrude outwardly along the vehicle width.

Further, this engine 10 is a 4-cycle engine equipped with a movable valve mechanism 32 that includes a double overhead cam shaft 31 (DOHC). In the movable valve mechanism 32, two cam shafts 31 close and open a suction valve 30*a* and an exhaust valve 30*b*, respectively. The DOHC 31 connects to the upper side of the respective valves 30*a* and 30*b* on the upper part of the cylinder head 23.

An engine exhaust system, comprised of an exhaust pipe 33 and muffler 34, connects to the front of cylinder assembly 25. An engine intake system, comprised of a carburetor 35, connects to the rear of the cylinder assembly 25. An air cleaner 36 positioned below the driving seat 13, connects to the upstream side of the carburetor 35. An engine cooling system, comprised of a pair of right and left radiators 37, sits between the rear portion of the head pipe 3 and the upper front portion of the engine 10.

Figure 4:
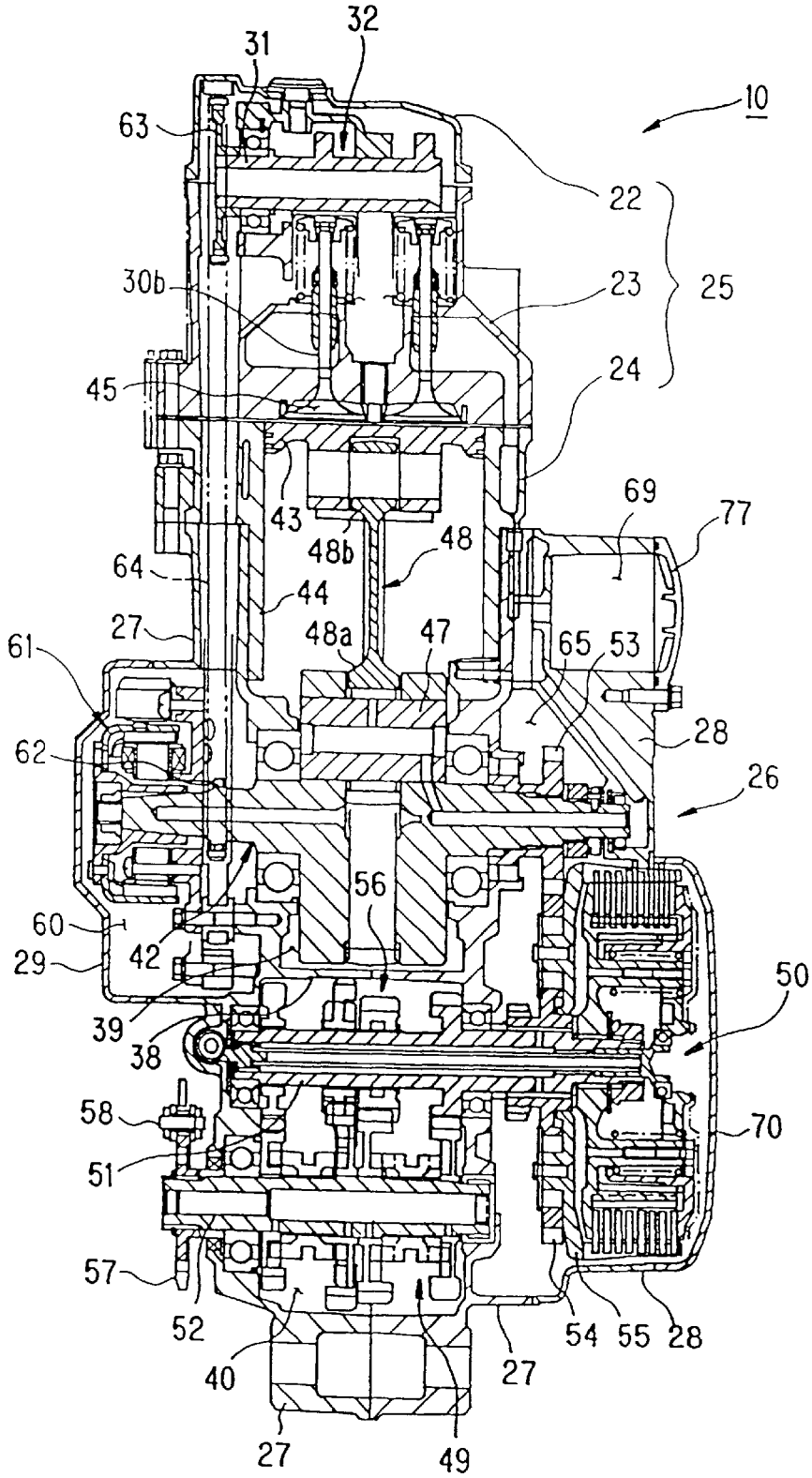
FIG. 4 is a cross-sectional view along the line IV—IV of FIG. 3.

As shown in FIGS. 2–4, the inside of the crankcase 27 is divided by a bulkhead 38 into a transmission chamber 40 in the back and a crank chamber 39 in the front. Lubrication oil is temporarily stored in an oil pan 41 in the lower part of the crankcase 27. The oil pan 41 is divided likewise into a back and front by the bulkhead 38.

In the crank chamber 39, a crankshaft 42 lies along the width direction of the vehicle. A cylinder bore 44 in a cylinder block 24 houses a piston 43. A combustion chamber 45 which is aligned with cylinder bore 44, is formed in the cylinder head 23. A spark plug 46 is fitted to this combustion chamber 45 from the outside.

A large end portion 48*a* of connecting rod 48 is coupled to a crank pin 47 which is generally positioned in the middle portion of the crankshaft 42, and a small end portion 48*b* of the connecting rod 48 is coupled to the piston 43. The piston 43 reciprocates in the cylinder bore 44 in the axial direction, and this reciprocating stroke rotates the crankshaft 42 via the connecting rod 48.

A transmission mechanism 49, which is a reduction gear, is provided in the transmission chamber 40. In this transmission mechanism 49, there is a counter shaft 51 positioned parallel to the crankshaft 42. The driving force from the crankshaft 42 is transferred to the counter shaft 51 via the clutch mechanism 50, and a drive shaft 52 transfers the driving force to the rear wheel 21.

A primary drive gear 53 rotates together with one end of the crankshaft 42, i.e., the right end in this embodiment. A primary driven gear 54 engages with this primary drive gear 53 and is pivotably supported on the counter shaft 51. The primary driven gear 54 is secured to the clutch body 55 and, by rotating together, transmits the rotating drive force to the clutch mechanism 50.

A plurality of transmission gears 56, etc., having different numbers of teeth are provided on the counter shaft 51 and drive shaft 52. Primary speed reduction is accomplished by changing the combination of these transmission gears 56, etc.

A drive sprocket 57 is provided on the end of the drive shaft 52 that protrudes out of the transmission chamber 40. This drive sprocket 57 is coupled to a driven sprocket 59, provided on the rear wheel 21 via a drive chain 58 which performs secondary speed reduction. As a result, the engine drive force is transmitted to the rear wheel 21.

A separate generator chamber 60 with a generator cover 29 lies above the crank chamber 39 and transmission chamber 40 on the left side of the crankcase 27. A generator 61 with a cam drive gear 62 sits on the left end of the crankshaft 42 that protrudes into the generator chamber 60.

Cam sprockets 63 are provided on one end of the cam shafts 31, which are placed on the cylinder head 23, and are coupled to cam drive gears 62 via the cam chain 64. The cam chain 64 transmits the rotation of the crank shaft 42 to the cam shaft 31, thereby operating the valve mechanism 32.

A clutch housing 28 having a removable clutch cover 70 is located on the right side of the crankcase 27. Inside the clutch housing 28, the clutch body 55 is housed in the rear, and an auxiliary chamber 65 is formed in the front. The auxiliary chamber 65 houses a cooling water pump 66 and a pair of oil pumps 67 and 68. A separate filter chamber 69 and an oil filter, which is not shown, are also housed in the clutch housing 28.

Figure 5:
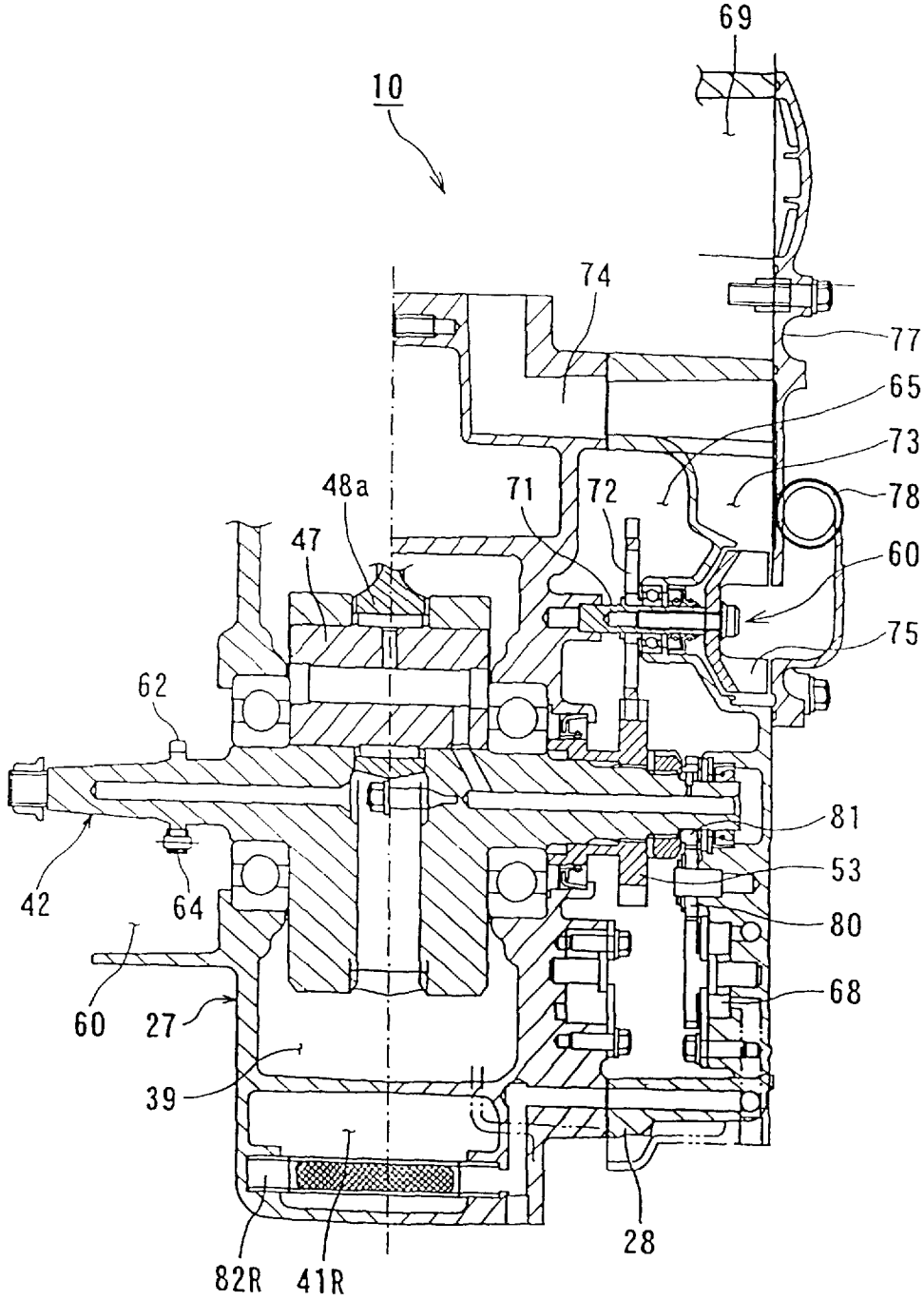
FIG. 5 is a cross-sectional view along the line V—V of FIG. 3.

As shown in FIG. 5, a cooling water pump shaft 71, which is located parallel to the crankshaft 42, is supported by a shaft between the right side of the crankcase 27 and the inner face of the clutch housing 28. A cooling water pump gear 72 that turns the primary drive gear 53 also rotates with the cooling water pump shaft 71. Furthermore, a cooling water pump chamber 73 in the clutch housing 28 near the cooling water pump gear 72 is connected to a cooling water passage 74 in the crankcase 27.

An impeller 75 is mounted on the end of the cooling water pump shaft 71 that protrudes toward the outside of the cooling water pump chamber 73, thereby forming the body of the cooling water pump 66. The filter chamber 69 and the cooling water pump chamber 73 are positioned close together and can both be closed with an aluminum cover member 77. This cover member 77 has a cooling water union 78, from which a cooling water hose 79 extends toward the radiator 37, as shown in FIG. 3.

Figure 6:
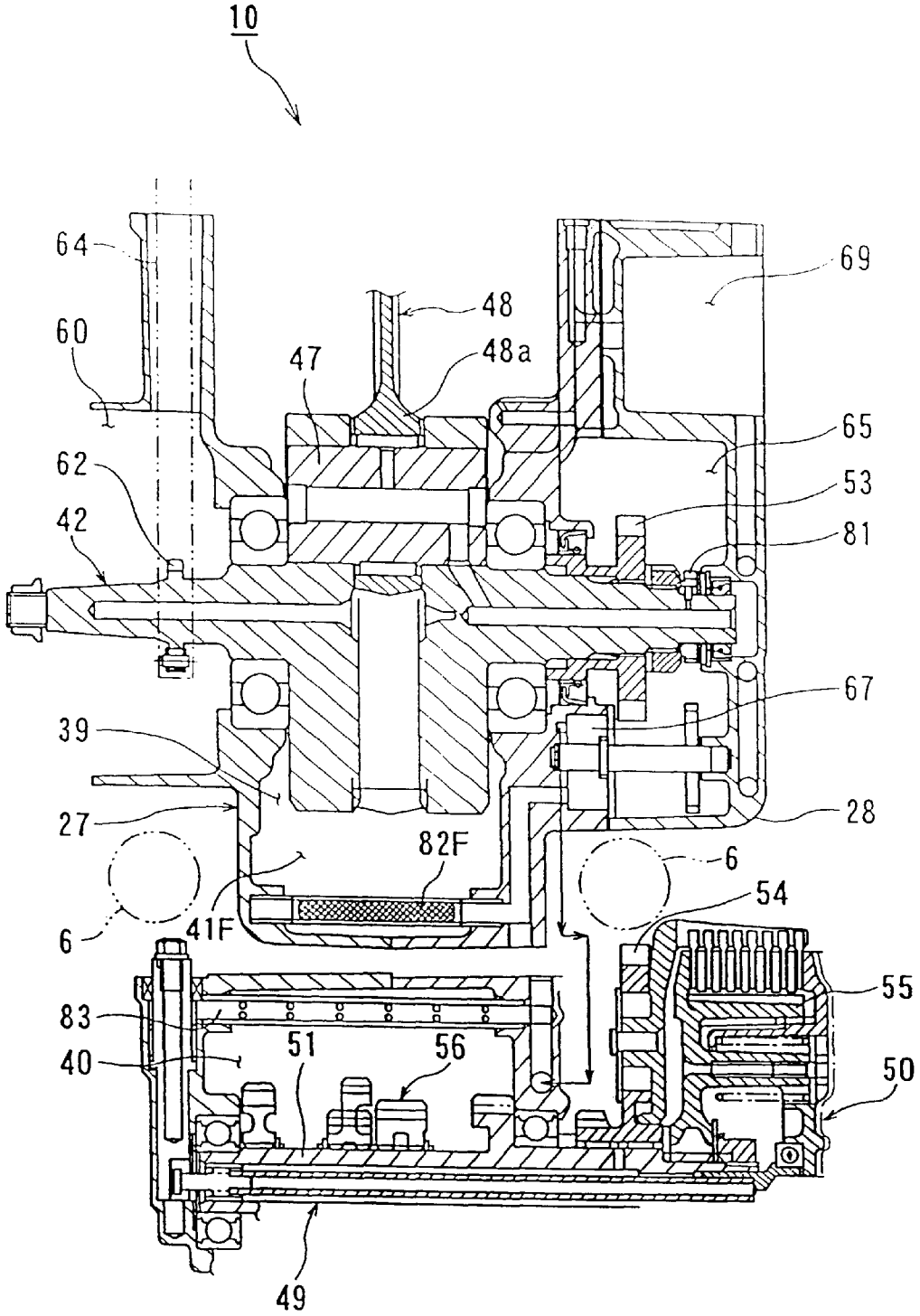
FIG. 6 is a cross-sectional view along the line VI—VI of FIG. 3.

As shown in FIGS. 3, 5 and 6, a pair of oil pumps, a scavenger pump 67 and a feed pump 68 are provided in the crankcase 27. Either of the oil pumps 67 and 68 can also be coupled to an oil pump drive gear 81 provided on the right end of the crankshaft 42 via the oil pump idle gear 80.

As shown in FIG. 6, the scavenger pump 67 pumps lubrication oil from an oil strainer 82F in the oil pan 41F in the crank chamber 39 and can transfer lubrication oil onto portions of the transmission mechanism 49, such as the counter shaft 51 and the drive shaft 52, from an oil passage 83 on the upper transmission chamber 40. The lubrication oil is then stored in the oil pan 41R in the transmission chamber 40.

As shown in FIG. 5, the feed pump 68 pumps lubrication oil from the oil strainer 82R in the oil pan 41R in the transmission chamber 40, not shown in detail. The feed pump 68 can transfer lubrication oil to the crankshaft 42, piston 43 and movable valve mechanism 32. Some of this lubrication oil drops into the generator chamber 60 and then into the crank chamber 39 to be stored in oil pan 41F.

As shown in FIG. 2, the first communication hole 84 on the crank chamber 39 connects to the lower generator chamber 60. This hole 84 is positioned above the lubrication oil level 85 in the oil pan 41F in the crank chamber 39. A second communication hole 86 connects to the transmission chamber 40 from the upper generator chamber 60.

The engine 10 described in this embodiment has a kick engine starting device 87 that transmits a rider's pedal force to the crankshaft 42 and also starts the engine 10. This starting device 87 comprises a kick pedal arm 88, kick drive gear 89, kick idle gear 90 and kick driven gear 91.

Figure 7:
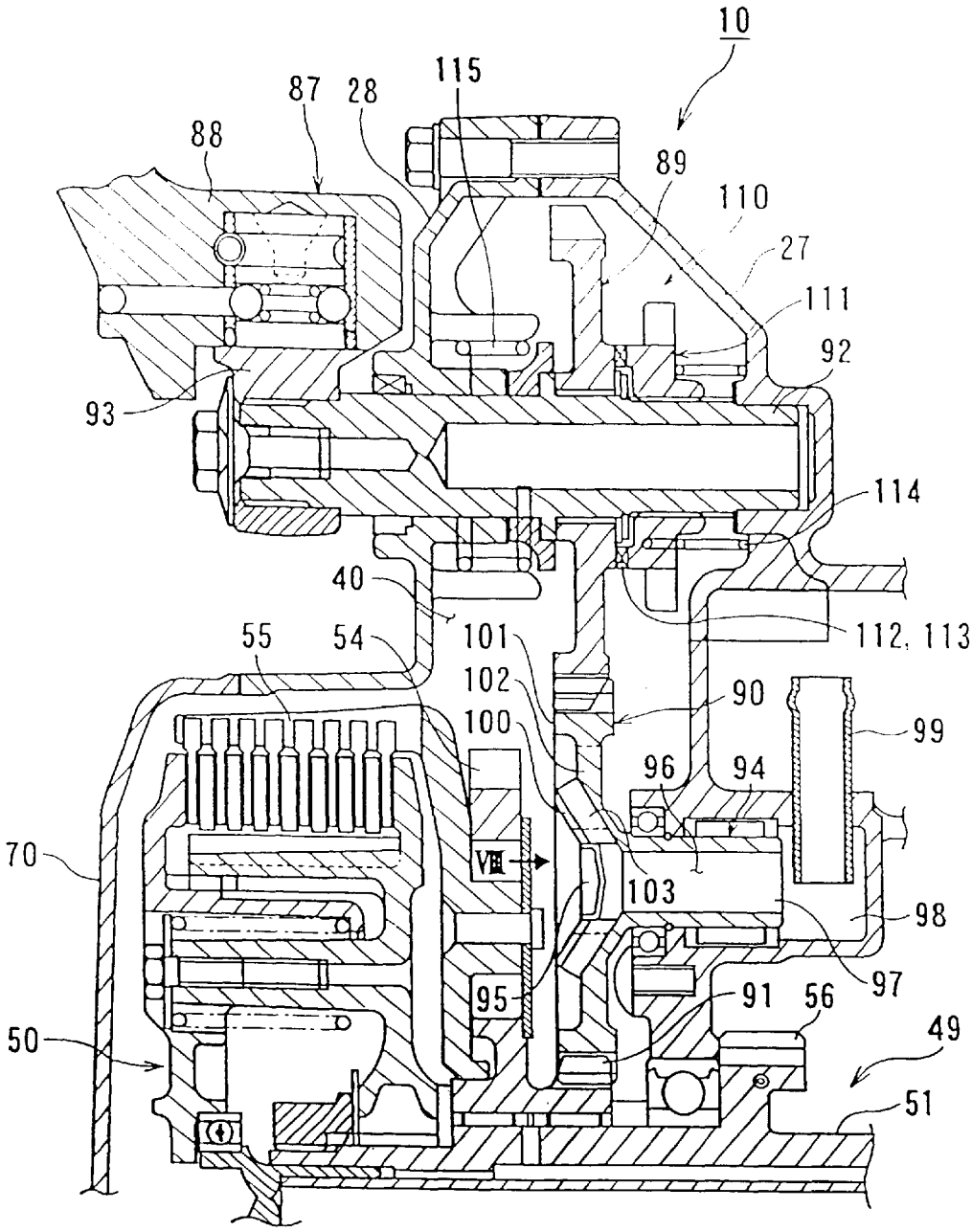
FIG. 7 is a cross-sectional view along the line VII—VII of FIG. 3.

As shown in FIGS. 3 and 7, a kick drive shaft 92 is parallel to the counter shaft 51 and the crankshaft 42 and is positioned on the rear right side of the crankcase 27. The ends of the kick drive shaft 92 are supported by the crankcase 27 and the clutch housing 28 to pivot. A part of the shaft 92 protrudes out from the clutch housing 28. A base end portion of the kick pedal arm 88 is mounted on this protruded portion via a hinge member 93. The kick drive shaft 92 turns independently from a kick drive gear 89 that rotates when the rider steps on the free end of the kick pedal arm 88.

As viewed from the side of the vehicle, a hollow kick idle shaft 94 is positioned on the upper rear of the parallel counter shaft 51 so that at least part of it overlays the clutch body 55. The kick idle shaft 94 is supported by the crankcase 27 to pivot when the side of the hollow kick shaft 51 is fixed.

A kick idle gear 90, located beside the clutch body 55, is arranged opposite to and facing the clutch body 55 and is formed as a single piece with, or attached to, the end of kick idle shaft 94. This kick idle gear 90 is coupled to the kick drive gear 89.

The primary driven gear 54 is attached to, and therefore rotates with, the clutch body 55 and is also attached to a kick driven gear 91, to which the kick idle gear 90 is coupled.

A ratchet mechanism 110 allows rotation to be transmitted only from the kick drive gear 89 to the kick idle gear 90, for example, as shown in FIG. 7. The ratchet mechanism 110 contains a ratchet wheel 111 located on the kick drive shaft 92 and adjacent to the kick drive gear 89. Ratchet pawls 112 and 113 are formed on the pair of surfaces of the kick drive gear 89 and the ratchet wheel 111 that face each other.

The ratchet wheel 111 is torsionally spline-connected to the kick drive shaft 92 and is normally force-applied onto kick drive shaft 92 by a return spring 114. A kick pedal arm 88 is held in a fixed position prior to being forced down by the return spring 115 on kick drive shaft 92.

When the kick pedal arm 88 is forced down, the kick drive gear 89 rotates in one direction. The ratchet wheel 111 turns, in a direction opposite to the kick drive gear 89 while rotating with the kick drive shaft 92. The ratchet pawls 112 of the ratchet wheel 111 engage with ratchet pawls 113 of the kick drive gear 89, thereby transmitting rotation of the kick drive shaft 92 to the kick drive gear 89. FIG. 7 illustrates the engagement of the kick drive gear 89 with the ratchet wheel 111 by the ratchet pawls 112 and 113.

When a rider forces down the free end of the kick pedal arm 88, the pedal force is transmitted to the kick drive shaft 92, ratchet wheel 111, kick drive gear 89, kick idle gear 90, kick driven gear 91, primary driven gear 54 and primary drive gear 53, consecutively, and is then transmitted to the crankshaft 42.

The kick pedal arm 88 is returned to its original position by the return spring 115 and rotates the kick drive shaft 92 in the opposite direction. With this rotation, the ratchet wheel 111 is detached from the kick drive gear 89. Therefore, the kick drive gear 89 does not continue to rotate after starting the engine 10. Rather, only the kick idle gear 90 and the idle shaft 94 continue to rotate.

Engine 10 is also provided with a breather means for relieving blow-by gas generated in the crankcase 27 and for separating sprayed oil mist mixed in the blow-by gas.

Figure 8:
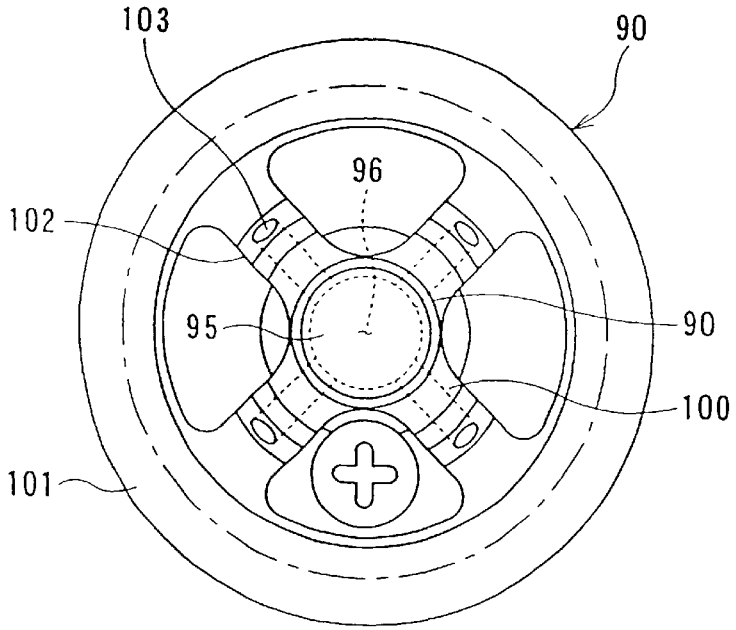
FIG. 8 is a view from the arrow VII of FIG. 7.

As shown in FIGS. 7 and 8, the end of the hollow kick idle shaft 94 closer to the clutch body 55 is closed with plug 95. The opposite end that protrudes from the crankcase 27 is open, and a breather passage 96 is located therein. The outlet of the breather passage 96 is the portion of the kick idle shaft 94 which protrudes out of the crankcase 27. Accordingly, a blow-by gas exhaust port 97 and is surrounded by the blow-by gas outlet chamber 98. In the blow-by gas outlet chamber 98, a breather union 99 connects with the outside and inside of the blow-by gas outlet chamber 98.

As shown in FIG. 8, the kick idle gear 90 may comprise the following: raised boss portions 100 on the peripheral edge of the kick idle shaft 94, an outer peripheral edge 101 on which gear teeth are provided (in FIG. 8, the illustration is omitted), and a plurality of spokes 102 coupling these boss portions 100 and outer peripheral edge 101. In these spoke portions 102, blow-by gas intake ports 103 connected to the breather passage 96 in the kick idle shaft 94 may be opposite to and face the clutch body 55.

Figure 9:
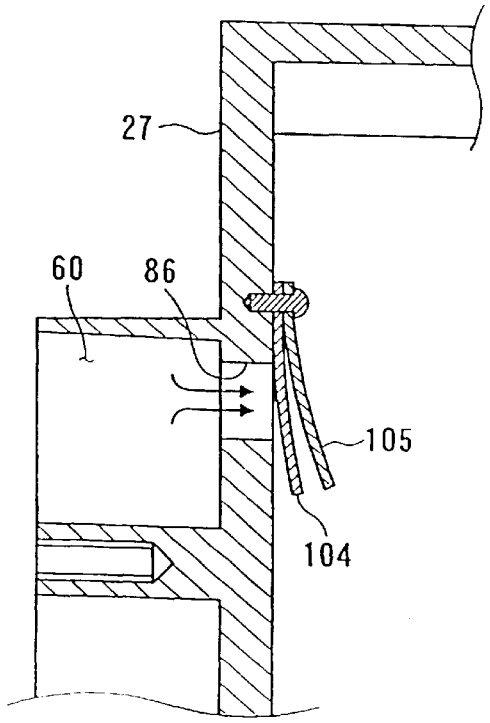
FIG. 9 is a cross-sectional view along the line IX—IX of FIG. 2.

As shown in FIG. 2 and FIG. 9, a lead valve 104, which is a check valve, is located in the second communication hole 86 connecting the upper generator chamber 60 and the transmission chamber 40. This lead valve 104 allows fluid to move only from the generator chamber 60 to the transmission chamber 40 and prevents back-flow.

FIG. 9 illustrate the engine 10 is at rest. Here, the lead valve 104 is opened by fluid pressure and closes the second communication hole 86 elastically. The maximum opening degree of the lead valve 104 is set by a stopper 105 which is tightened with the lead valve 104.

A mode of operation of the present engine will be described below.

The engine 10 is started by a rider forcing down the kick pedal arm 88. During operation of the engine 10, the kick idle gear 90 always rotates with the kick idle shaft 94.

During operation of the engine 10, pressurized gas from the cylinder bore 44 gradually leaks into the crank chamber 39 in the crankcase 27 through the space between the piston 43 and the cylinder bore 44. This gas, in which lubrication oil is mixed in a sprayed manner, i.e., blow-by gas, flows into the generator chamber 60 on the left side of the crankcase 27 from the crank chamber 39 through the first communication hole 84. The blow-by gas also pushes and opens the lead valve 104 to flow into the transmission chamber 40 from the second communication hole 86.

The blow-by gas, which flowed into the transmission chamber 40, flows into the breather passage 96 from the blow-by gas intake port 103 provided on the kick idle gear 90. The blow-by gas is then re-circulated to the air cleaner 36 from the breather union 99 provided in the blow-by gas outlet chamber 98 via a breather hose, not shown, and is delivered to the combustion chamber 45 with new air and is burned again, thereby preventing air pollution.

The kick idle gear 90 with the blow-by gas intake port 103, and the kick idle shaft 94 with the breather passage 96 are arranged so that at least some of these components, or parts thereof, overlay the clutch body 55, as viewed from the side. The blow-by gas intake port 103 is arranged opposite and facing the clutch body 55. Therefore, sprayed oil mist mixed in the blow-by gas is sufficiently separated by centrifugal force of rotation of the clutch body 55 and the kick idle gear 90 before flowing into the breather passage 96 from the blow-by gas intake port 103. Only blow-by gas without oil mist is re-circulated to the air cleaner 36.

This eliminates the need for a breather chamber for separating the oil mist, and a compact, lighter weight engine 10 has a simple structure. The separated oil mist falls by gravity and is returned to the oil pan 41R in the transmission chamber 40.

The continuous fluctuation of the pressure in the crankcase 27 resulting from the sliding of the piston 43 can be accommodated by the breather passage 96 in the hollow kick idle shaft 94. Since the inner diameter of the breather passage 96 is small with respect to the entire capacity of the crankcase 27, the breather passage 96 functions as an orifice whose dimensions can be altered because it is within the kick idle shaft 94. The amount of pressure that is absorbed can be adjustable or predetermined.

By arranging the kick idle shaft 94 on the upper rear of the counter shaft 51, as viewed from the side of the vehicle, the breather passage 96 is placed sufficiently away from the lubrication oil in the oil pan 41R in the transmission chamber 40, and blow-by gas which does not contain oil mist can be taken in. The lubrication oil in the oil pan 41R cannot flow out from the breather passage 96 if the motorcycle 1 stops suddenly or falls.

Furthermore, by locating the first communication hole 84 between the crank chamber 39 and the lower generator chamber 60 and by locating the second communication hole 86 between the transmission chamber 40 and the upper generator chamber 60, the lead valve 104, which is a check valve, allows fluid to move only from the generator chamber 60 to the transmission chamber 40 through the second communication hole 86. Thereby, the lubrication oil, which lubricates each portion of the engine 10 and drops to the generator chamber 60, can be returned to the oil pan 41F in the crank chamber 39. The lubrication oil will not flow into the transmission chamber 40 when blow-by gas is directed to the transmission chamber 40 from the crank chamber 39. Further, the lead valve 104 prevents blow-by gas in the transmission chamber 40 from back-flowing into the crank chamber 39.

Additionally, by locating the first communication hole 84 above the oil level 85 of the lubrication oil stored in the oil pan 41F in the crank chamber 39, the lubrication oil is prevented from flowing into the generator chamber 60.

What is claimed is:

1. A breather apparatus for a 4-cycle engine, said 4-cycle engine comprising a crankcase is divided with a bulkhead into a crank chamber in which a crankshaft is housed and a transmission chamber in which a clutch body is supported by a counter shaft, an oil pan to store lubrication oil in each chamber, a pair of oil pumps in said crank chamber, one of said pumps being adapted to take in lubrication oil from said oil pan in said crank chamber, and the other of said oil pumps being adapted to take in lubrication oil from said oil pan in said transmission chamber, a kick engine starter having a pedal comprising a kick idle gear adapted to start said engine by transmitting a force applied said pedal to said crankshaft via said clutch body and a plurality of gears, a hollow kick idle shaft which supports one end of said kick idle gear and rotates on the upper rear of said counter shaft in said transmission chamber and having at least a part of which overlaying said clutch body, a breather passage located in said kick idle shaft, a blow-by gas intake port on the side end of said kick idle gear; and a blow-by gas exhaust port located on the end of the opposite side of said kick idle gear.

2. A breather apparatus as defined in claim 1, wherein said kick idle gear is located opposite to and facing said clutch body, and wherein said blow-by gas intake port communicates with said breather passage in said kick idle shaft and is located on said kick idle gear.

3. A breather apparatus as defined in claim 1, further comprising a generator chamber separate from said crankcase is located on the left side of said crankcase and across said crank chamber and said transmission chamber in said crankcase, a generator covered with a generator cover in said generator chamber, a first communication hole communicating with the inside of said crank chamber located on the bottom of said generator chamber, a second communication hole communicating with the inside of said transmission chamber located on the top of said generator chamber, and a check valve, in said second communication hole, adapted to allow fluid to move only from the inside of said generator chamber to the inside of said transmission chamber.

4. A breather apparatus as defined in claim 2, further comprising a generator chamber separate from said crankcase is located on the left side of said crankcase and across said crank chamber and said transmission chamber in said crankcase, a generator covered with a generator cover in said generator chamber, a first communication hole communicating with the inside of said crank chamber located on the bottom of said generator chamber, a second communication hole communicating with the inside of said transmission chamber located on the top of said generator chamber, and a check valve, in said second communication hole, adapted to allow fluid to move only from the inside of said generator chamber to the inside of said transmission chamber.

5. A breather apparatus as defined in claim 3, wherein said first communication hole is located above the level of any lubrication oil stored in the oil pan in said crank chamber side.

6. A breather apparatus as defined in claim 4, wherein said first communication hole is located above the level of any lubrication oil stored in the oil pan in said crank chamber side.

7. A breather apparatus for a 4-cycle engine, said 4-cycle engine comprising a crankcase is divided with a bulkhead into a crank chamber in which a crankshaft is housed and a transmission chamber in which a clutch body is supported by a counter shaft, an oil pan to store lubrication oil in each chamber, a pair of oil pumps in said crank chamber, one of said pumps being adapted to take in lubrication oil from said oil pan in said crank chamber, and the other of said oil pumps being adapted to take in lubrication oil from said oil pan in said transmission chamber, a kick engine starter having a pedal comprising a kick idle gear adapted to start said engine by transmitting a force applied said pedal to said crankshaft via said clutch body and a plurality of gears, a hollow kick idle shaft which supports said kick idle gear on one end of said kick idle shaft and is positioned on the upper rear of said counter shaft in said transmission chamber and having at least a part of which overlaying said clutch body, a breather passage located in said kick idle shaft, a blow-by gas intake port on the side end of said kick idle gear; and a blow-by gas exhaust port located on the end of the opposite side of said kick idle gear.

8. A breather apparatus as defined in claim 7, wherein said kick idle gear is located opposite to and facing said clutch body, and wherein said blow-by gas intake port communicates with said breather passage in said kick idle shaft and is located on said kick idle gear.

9. A breather apparatus as defined in claim 7, further comprising a generator chamber separate from said crankcase is located on the left side of said crankcase and across said crank chamber and said transmission chamber in said crankcase, a generator covered with a generator cover in said generator chamber, a first communication hole communicating with the inside of said crank chamber located on the bottom of said generator chamber, a second communication hole communicating with the inside of said transmission chamber located on the top of said generator chamber, and a check valve, in said second communication hole, adapted to allow fluid to move only from the inside of said generator chamber to the inside of said transmission chamber.

10. A breather apparatus as defined in claim 8, further comprising a generator chamber separate from said crankcase is located on the left side of said crankcase and across said crank chamber and said transmission chamber in said crankcase, a generator covered with a generator cover in said generator chamber, a first communication hole communicating with the inside of said crank chamber located on the bottom of said generator chamber, a second communication hole communicating with the inside of said transmission chamber located on the top of said generator chamber, and a check valve, in said second communication hole, adapted to allow fluid to move only from the inside of said generator chamber to the inside of said transmission chamber.

11. A breather apparatus as defined in claim 9, wherein said first communication hole is located above the level of any lubrication oil stored in the oil pan in said crank chamber side.

12. A breather apparatus as defined in claim 10, wherein said first communication hole is located above the level of any lubrication oil stored in the oil pan in said crank chamber side.

* * * * *